US005149092A

United States Patent [19]

Parsons

[11] Patent Number: 5,149,092

[45] Date of Patent: Sep. 22, 1992

[54] LOCKING MEANS FOR EXTENDABLE BATON

[76] Inventor: Kevin Parsons, 16 Wagon Wheel Dr., Appleton, Wis. 54915

[21] Appl. No.: 746,468

[22] Filed: Aug. 16, 1991

[51] Int. Cl.[5] ..... F41B 15/02

[52] U.S. Cl. ..... 273/84 R; 135/40; 135/75

[58] Field of Search ..... 273/80 D, 84 R, 84 ES; 135/37, 40, 41, 75; 285/298, 301, 302, 317; 403/358, 377, 378

[56] References Cited

U.S. PATENT DOCUMENTS

| | | | |
|---|---|---|---|
| 27,335 | 2/1860 | Rowe | 273/84 R |
| 116,097 | 6/1871 | Reichard | 273/84 R |
| 365,644 | 6/1887 | Smith | 135/40 |
| 1,716,131 | 6/1929 | Hodgson | 273/84 R |
| 2,980,456 | 4/1961 | McMullin | 403/378 X |
| 2,989,968 | 6/1961 | Vogel | 403/378 |
| 3,371,930 | 3/1968 | Shiga | 273/84 R |
| 3,712,652 | 1/1973 | Uilkema | 273/80 D |
| 4,037,839 | 7/1977 | Nelson | 273/84 R |
| 4,752,072 | 6/1988 | Parsons | 273/84 R |
| 4,964,636 | 10/1990 | Ashihara | 273/84 R |

FOREIGN PATENT DOCUMENTS

| | | | |
|---|---|---|---|
| 0543517 | 7/1957 | Canada | 273/84 R |
| 0040499 | 2/1990 | Japan | 273/84 R |
| 00165565 | 7/1903 | United Kingdom | 273/84 R |

*Primary Examiner*—Theatrice Brown
*Assistant Examiner*—William M. Pierce
*Attorney, Agent, or Firm*—Andrus, Sceales, Starke & Sawall

[57] ABSTRACT

An extendable baton includes a hollow tubular barrel with nesting telescoping members which may be extended to a fully expanded position. The telescoping members are held in the closed position and the opened expanded position by a detent lock, with the ends of the telescoping members designed to engage each other in a positive, rigid, non-interfering relationship by using multiple, parallel tapered stop surfaces.

19 Claims, 1 Drawing Sheet

LOCKING MEANS FOR EXTENDABLE BATON

BACKGROUND OF THE INVENTION

1. Field of the Invention

This invention relates generally to police batons or night sticks and is specifically directed to an extendable baton.

2. Description of the Prior Art

Extendable police batons or night sticks are known in the art. Typically, the baton is designed to be of a reduced or collapsible length when in the collapsed or retracted position, permitting a police officer to more easily carry or stow the baton than the one piece wand batons. Under certain circumstances, it is desirable to expand the baton to an extended length to facilitate certain police activities such as, by way of example, holding back crowds of people or to ward off an attacker or other person without having to approach too closely to him.

Examples of extendable batons are shown in U.S. Pat. No. 27,335 issued to J. L. Rowe on Feb. 28, 1860; U.S. Pat. No. 3,371,930 issued to Y. Shiga on Mar. 5, 1968 and U.S. Pat. No. 4,037,839 issued to N. C. Nelson on Jul. 26, 1977. The Rowe patent discloses an extendable baton having a solid core with a hollow tubular outer shell which may be extended and retracted along the longitudinal axis of the hollow cylindrical core to extend or collapse the baton. An elongate leaf spring is provided on the sleeve and includes a detent button which engages an annular stop provided on the core for holding the baton in the retracted position. The Shiga patent discloses a telescoping baton comprising a plurality of nested hollow tubular members which are movable between a fully nested retracted position and a fully extended, expanded position. Detent buttons are provided on the telescoping members and project outwardly beyond the end wall of the adjacent member, when the baton is extended, for locking the baton in the fully extended position. The baton members include rings at their abutting ends to define positive stops. Shiga also shows an inwardly projecting detent-type lock which protrudes outwardly from the baton and is spring-loaded and self-actuated to permit collapse of the telescoping member. The Nelson patent discloses a telescoping baton, wherein an elongate compression spring is housed within the telescoping members and is designed to bias the baton into the fully extended position when a locking release is disengaged to release the baton from its nested, retracted condition.

As extendable batons have become generally accepted in police use, certain disadvantages and shortcomings of the prior art batons have surfaced. For example, batons have to be of rigid construction and are required to provide a rigid assembly when both in the nested and the expanded positions. However, the batons have to be easy to retract without applying a substantial axial force, possibly damaging adjacent surfaces when attempting to contract the baton. For example, extendable batons have achieved limited success with the Coast Guard due to the necessity to provide an axial blow on the tip of the baton in order to retract it and break the wedge locking means of taper type batons. This type of configuration does not lend itself well to shipboard use.

SUMMARY OF THE INVENTION

The extendible baton of the subject invention comprises an outer handle or barrel made of a tubular construction for housing one or more telescoping members. The telescoping members have an increasing taper on one end which is adapted to nest and engage the decreasing taper on the outer end of the barrel in order to provide a rigid assembly when the baton is expanded to the extended position. A stepped stop surface is provided between the tapered end portion of each member and the cylindrical main body of the barrel and telescoping member. The stepped stop is at an angle acutely intercepting the longitudinal axis of the baton, preferably in the neighborhood of 30°. The angled surface distributes any forces applied against the baton in both axial and radial directions, using the compressive, tensile and hoop strengths of the assembly to distribute stresses and assure integrity of the assembly during use. The angled step provides a positive stop for limiting the movement of the telescoping member relative to the barrel, and the mated tapered end walls provide a rigid, non-interfering engagement resulting in a rigid assembly when the baton is disposed in the fully extended position.

In the preferred embodiment, a detent locking mechanism is disposed in the telescoping member outwardly of the outer end of the barrel or adjacent telescoping member, and extends through the telescoping member to provide an abutment stop for precluding inadvertent collapse and retraction of the telescoping member into the baton handle. The detent mechanism is dimensioned to always stay at or below the surface of the abutment member to minimize the likelihood of inadvertent depression of the detent, rendering it difficult for an assailant to grasp the baton and collapse it as it is being used by an authorized party. Use of the detent mechanism in combination with tapered nesting surfaces assures that the baton will not prematurely collapse by application of radial forces which can, at times, dislodge a wedge lock system. The detent mechanism of the subject invention also provides for telescoping members which are rotational a full 360° relative to one another, eliminating twisting destructive attempts.

In the preferred embodiment, the detent is secured to a substantially "C-shaped" leaf spring having an enlarged flat base which extends generally in the direction parallel to the longitudinal axis of the baton. The opposite ends of the legs of the leaf spring are upturned at their outer ends to minimize the tendency of the legs to snag or engage the interior surface of the telescoping member as the detent is depressed and the baton is retracted. This also assures that both legs of the spring move in a uniform manner, providing a uniform biasing force against the detent.

It is, therefore, an object and feature of the subject invention to provide for an extendable baton wherein the telescoping members of the baton nest fully within the baton barrel in the collapsed position and may be extended to an expanded position, wherein the telescoping members are maintained in a rigid assembly.

It is another object and feature of the subject invention to provide an extendable baton with positive, non-interfering stops for holding the baton in the extended position.

It is yet another object and feature of the invention to provide for an extendable baton wherein a detent type stop is used to hold the baton in both the expanded and the collapsed position.

It is yet another object and feature of the invention to provide for a detent stop which cannot be readily and inadvertently depressed in order to cause premature collapse and retraction of the baton.

Other objects and features of the invention will be readily apparent from the accompanying drawing and detailed description of the preferred embodiment.

DESCRIPTION OF THE PREFERRED EMBODIMENT

Figure 1:
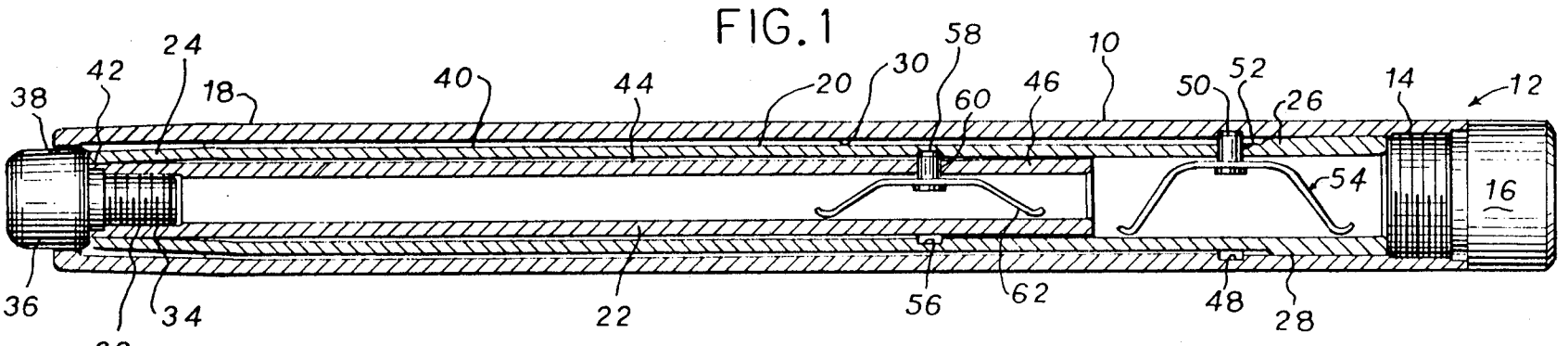
FIG. 1 is a side elevation view, partially in section, of a baton in accordance with the subject invention and shown in the fully retracted, nested position.

The preferred embodiment of a baton in accordance with the subject invention is shown in FIG. 1. The baton comprises an elongate hollow tube 10 defining the barrel or handle of the baton and having a first open end 12 which is tapped as at 14 for receiving the threaded end cap 16. The opposite end of the baton is swaged as at 18 to provide a reducing tapered outer end.

In the preferred embodiment of the invention, the first telescoping member 20 and the second telescoping member 22 are adapted to be inserted into the barrel 10 through the open end 12 prior to securing the end cap 16 therein. The first telescoping member 20 comprises an elongate hollow tube having a reducing tapered outer end 24 and an enlarged tapered inner end 26. The diameter of the outside peripheral wall 28 of largest cross-section of the first telescoping member 20 is slightly smaller than the diameter of the cylindrical portion of the inside peripheral wall 30 of the barrel. This permits smooth sliding movement between the two members, with minimum interference and friction.

The second telescoping member 22 comprises an elongate hollow tube having a straight or non-tapered open outer end 32 which is internally tapped as at 34 for receiving the threaded telescope tip 36. The outer end 18 of the barrel 10 includes a central through opening 38 large enough to accommodate the tip 36 and the cylindrical outside perimeter wall 40 of the first telescoping section 20. The outer end 24 of the first telescoping member 22 also includes a through central opening 42 large enough to accommodate the cylindrical outer wall 44 of the second telescoping member.

The opposite or inside end 46 of the second telescoping member 22 is also an enlarged taper, the angle of the taper of end 46 being substantially identical to the angle of swaged taper of the outer end 24 of the first telescoping member 20. Likewise, the angle of taper of the inner end 26 of the first telescoping member 20 is substantially identical to the angle of swage taper of the outer end 18 of the barrel 10.

An annular groove 48 is provided in the barrel 10 and is adapted for receiving the detent button 50 which passes through the clearance hole 52 in the first telescoping member 20. The detent button 50 is mounted on the substantially C-shaped leaf spring 54, in the well known manner, and is normally biased outward from the outer side wall 40 of the telescoping member 10 and toward the barrel 10. The first telescoping member 20 also includes an annular groove 56 which is adapted for receiving the detent button 58 which passes through the clearance hole 60 in the second telescoping member 22. The detent button 58 is likewise suitably mounted on a substantially C-shaped leaf spring 62 which is disposed in the hollow interior of the second telescoping member for normally urging the detent button 60 outwardly from the outer side wall 44 of the second telescoping member into the wall of the first telescoping member 20.

When the baton is in the retracted, nested condition of FIG. 1, the detent buttons 50 and 58 are biased toward and project into the annular grooves 48 and 56, respectively, for maintaining the baton in the nested position. The force of the springs 54 and 62 is sufficient to hold the baton in the nested condition during normal conditions.

Figure 5:
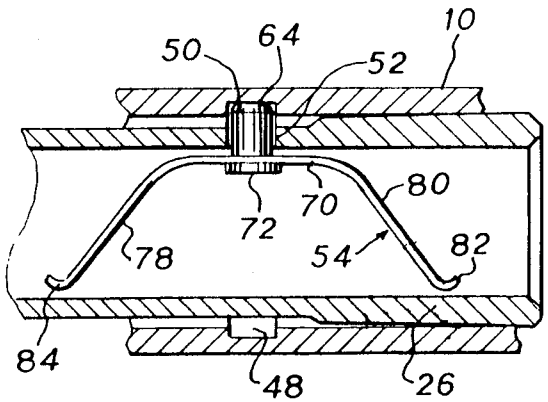
FIG. 5 is an enlarged fragmentary view, in section, showing the baton in the retracted position.

As shown in FIG. 5, each of the detent buttons include a radius 64 at the outer end. The rounded outer end of the button permits the button to be disengaged from the respective annular groove when a sufficient axial force is applied to the telescoping members of the baton either by providing a fast swinging or jerking motion of the baton to release it to the extended position or by pulling on first the outer tip 36 and, after the inner telescoping member 22 is fully extended, the second telescoping member 20 to release the buttons from the annular grooves.

Figure 2:
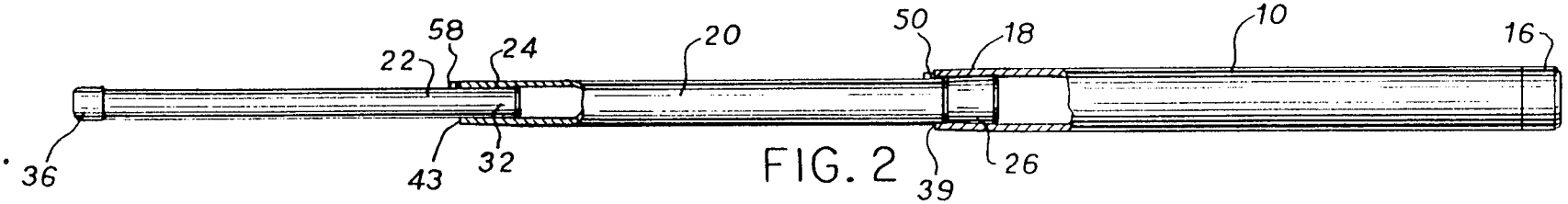
FIG. 2 is an elevation view, partially in section, showing the baton of FIG. 1 in the extended position.

As shown in FIG. 2, when the baton is fully extended and the two telescoping members 20 and 22 are extended axially outwardly from the barrel 10, the like tapered ends 18 and 26 of the barrel and the first telescoping member 20 and the like-tapered ends 24 and 32 of the first telescoping member 20 and the second telescoping member 22, respectively, act as positive stops limiting the movement of the baton members relative to one another. The detent buttons 50 and 58 are disposed just beyond and adjacent to the outer ends 39 and 43 of the respective members, whereby the detent buttons are urged beyond the outer walls of the telescoping members and into abutting relationship with the outer ends to serve as a positive stop for precluding accidental retraction or collapse of the baton.

In the preferred embodiment of the invention, the detent buttons are approximately ⅜-inch in diameter and extend outwardly from the respective outer side walls of the telescoping members to a distance not exceeding the raised abutting outer side wall of the adjacent telescoping member or barrel. This precludes any attempt by the assailant to grab the perimeter of the baton and retract the detent button, and thereby causing collapse of the baton during use.

Figure 3:
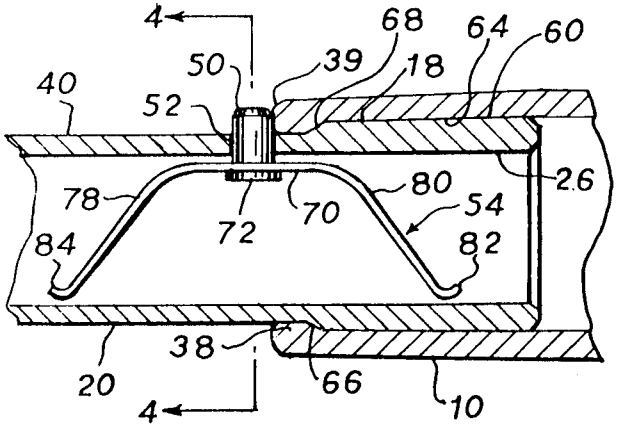
FIG. 3 is an enlarged fragmentary view, in section, showing the baton in the extended position.

As shown, the tapered surfaces of the various telescoping members and barrel are of like taper angle and are substantially parallel to one another. Thus, while a sliding engagement is provided, permitting the adjacent tapers to come into parallel contact with one another as shown in FIG. 3, the telescoping members are non-locking. With particular reference to FIG. 3 in the preferred embodiment of the invention, the outer end 39 of the barrel is shown in abutting relationship with the extended detent button 50 of the first telescoping member 20. As best seen in FIG. 5, the tapered end 18 of the barrel includes an interior tapered surface 64 of approximately ½° relative to the barrel axis. The tapered outside surface 66 of the tapered end 26 of the first telescoping member 20 is at an angle of approximately ½° relative to the axis of the baton. This assures that the baton barrel and telescoping member 20 will be disposed in a firm nesting relationship when the baton is fully extended, but that the telescoping member 20 will not become wedged or locked into the outer end of the barrel, making retraction difficult, if not impossible.

A step surface 66 is provided inwardly of the taper surface 60 of the telescoping member 20. The step surface 66 intercepts the barrel axis at an angle of approximately 30°. A like angled interior step surface 68 is provided inwardly of the outer end 39 of the barrel and is adapted to receive and engage the step surface 66 of the telescoping member, providing a positive, non-locking stop for limiting the extension of the telescoping member 20 relative to the barrel 10. The central through bore 38 in the end of the barrel is adapted to receive the cylindrical side wall 40 of the telescoping member in a sliding noninterfering relationship. The stop angles also facilitate depression of the detent buttons 50 and 58 as the baton is moved from the collapsed to the expanded position. Also, it has been found that the 30° angles used in the preferred embodiment distribute both axial and radial blows against the baton to take advantage of the compressive, tensile and hoop strengths of the assembly.

Thus, the detent button 50 provides the sole locking means for locking the baton against retraction, wherein the non-locking abutment surfaces 66 and 68 provide the positive stop for maintaining the baton in its fully extended position. The like tapered ends provide a firm, rigid assembly when the baton is fully extended. By using the non-locking positive stop surfaces 66 and 68 in conjunction with the non-locking, nesting tapers on surfaces 60 and 64, the baton may be held in a firm substantially rigid extended position without an interference fit between telescoping members. The non-interfering tapers provide a rigid assembly with a minimum of axial "wobble" when the baton is extended.

The baton may be retracted to its nested closed position of FIG. 1 by retracting the detent button to a position at or beneath the outer surface of the side wall 40 of the telescoping member 20, permitting the detent button to pass through the central bore 38 in the barrel and allowing the telescoping member 20 to be fully withdrawn into the barrel 10.

It will be readily understood that the identical locking and positive stop configuration is utilized on the outer end 24 of the first telescoping member in conjunction with the tapered inner end 32 of the second telescoping member 22, employing the detent button 58, the outer end 43 of member 20 and the like tapered end portions 24 and 32. Similar step surfaces 66, 68 are provided for defining a positive, non-locking stop.

Figure 4:
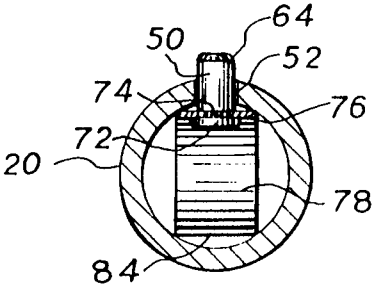
FIG. 4 is a sectional view taken generally along the line 4—4 of FIG. 3.

In the preferred embodiment of the invention, the springs 54 and 62 each comprise a substantially flat base portion 70 through which the button 50 or 58 is inserted. Typically, the button 50 includes an enlarged head area 72 and an internal annular groove 74 (FIG. 4). The spring base 70 includes a through hole 76 which is adapted to be snap fitted tightly within the annular groove 74 for maintaining the button in the spring.

A pair of leaf spring legs 78 and 80 radiate outwardly from the base 70 in a direction generally opposite the direction of the projecting detent button 50. The legs 78 and 80 are angled relative to the axis of the detent button to provide a good spring force when the spring is mounted in the interior of the tubes as shown in FIGS. 1, 3 and 5. In the preferred embodiment, the outer ends 82 and 84 of the spring legs 78, 80 are each provided with an upwardly turned radius to assure that the tips of the spring legs do not engage and gouge the interior surface of the hollow telescoping members. This permits the spring to expand and contract equally by sliding along the interior surface of the telescoping members, assuring that the spring maintains consistent resiliency after repeated uses. The flat base 70 assures that the button will not become cocked or skewed relative to the barrel or telescoping members when a substantial axial force is applied against the outer end of the extended baton. This provides additional assurance against premature retraction of the detent buttons 50 and 58, and reduces the likelihood of unanticipated collapse and retraction of the baton. The upturned spring ends 82 and 84 also facilitate in disassembly of the baton, when required. The button may be withdrawn below the through hole by an appropriate push rod and the upturned end may be engaged, permitting axial withdrawal of the spring.

While certain features and embodiment of the invention have been described herein, it will be readily understood that the invention includes all modifications and enhancements within the scope and spirit of the following claims.

I claim:

1. An extendable baton of the type having an outer tubular handle defining a baton axis, the handle with a capped end, an open end and an inner peripheral wall, and at least one nesting, telescoping member having an outer peripheral wall, said telescoping member carried in said handle within said inner peripheral wall and axially movable relative thereto between a fully retracted, nested position, and a fully extended, expanded position, the baton further including means for selectively maintaining the telescoping member in either the retracted or expanded position, said means comprising:

a. a positive stop for limiting the axial movement of the telescoping member relative to the handle when in the extending position, said positive stop adapted for engaging a portion of the inner peripheral wall of the handle with a portion of the outer peripheral wall of the telescoping member in a noninterfering relationship for maintaining the axial alignment of the handle and the telescoping member;

b. a locking device movable between a first, locked position and a second, unlocked position for selectively locking the telescoping element in one of the extended and retracted positions; and c. an annular channel in the inner peripheral wall of the handle, and adapted for receiving the locking device for locking the telescoping element in a retracted position.

2. The extendable baton of claim 1, wherein said positive stop means further comprises:

a. a first stop surface on the inner peripheral wall of said handle; and b. a complementary second stop surface on the outer peripheral wall of said telescoping member, whereby movement of the telescoping member from the retracted position to the extended position places the complementary stop surfaces in positive, non-interfering engagement with one another.

3. The extendable baton of claim 2, wherein the first stop surface comprises a first tapered inner peripheral wall portion intersecting the baton axis at a first acute angle and a second tapered inner peripheral wall portion intersecting the baton axis at a second acute angle, and wherein said second stop surface includes first and second tapered wall portions on said outer peripheral wall, complementary with sand intersecting the baton axis at the substantially same angles as the first stop surface.

4. The extendable baton of claim 3, wherein the first acute angle is approximately ½° and the second acute angle is approximately ½°.

5. The extendable baton of claim 3, wherein said stop surface is adjacent the open end of said handle and wherein said first tapered surface is a cold formed surface.

6. The extendable baton of claim 5, wherein the telescoping member is generally cylindrical and the second stop surface thereon is defined by an increasing taper, and wherein the open end of said handle is larger than the generally cylindrical portion of the telescoping member but smaller than the increasing taper thereof.

7. The extendable baton of claim 6, wherein the handle includes a removable cap at said capped end and a through opening of sufficient cross section to receive the increasing taper of the telescoping member.

8. An extendable baton of the type having an outer tubular handle defining a baton axis, the handle with a capped end, an open end and an inner peripheral wall, and at least one nesting, telescoping member having an outer peripheral wall, said telescoping member carried in said handle within said inner peripheral wall and axially movable relative thereto between a fully retracted, nested position, and a fully extended, expanded position, the baton further including means for selectively maintaining the telescoping member in either the retracted or expanded position, said means comprising:

a. a positive stop for limiting the axial movement of the telescoping member relative to the handle when in the extended position;

b. a detent mechanism in said telescoping member and adapted for moving between a projected, handle engaging position for locking the telescoping member relative to the handle in a retracted position for permitting relative movement between the handle and the telescoping member;

c. a biasing element for urging the detent mechanism into the projected position;

d. a first lock element comprising an annular channel in the inner peripheral wall of the handle, and adapted for receiving the detent mechanism when the baton is in the retracted position; and e. a second lock element associated with said handle for engaging the detent mechanism when the baton is in the expanded position.

9. The extendable baton of claim 8, wherein said telescoping member and said handle are rotatable 360° relative to one another.

10. The extendable baton of claim 9, wherein said second locking means comprises the open end of said handle.

11. The extendable baton of claim 8, wherein said positive stop means includes a sloped surface on said inner peripheral wall of the handle and adapted for engaging and depressing said detent mechanism as the telescoping member is moved from the retracted to the expanded position.

12. An extendable baton of the type having an outer tubular handle defining a baton axis, the handle with a capped end, an open end and an inner peripheral wall, and at least one nesting, telescoping member having an outer peripheral wall, said telescoping tubular member carried in said handle within said inner peripheral wall and axially movable relative thereto between a fully retracted, nested position, and a fully extended, expanded position, the baton further including means for selectively maintaining the telescoping member in either the retracted or expanded position, said means comprising:

a. a positive stop for limiting the axial movement of the telescoping member relative to the handle when in the extended position; said positive stop adapted for engaging a portion of the inner peripheral wall of the handle with a portion of the outer peripheral wall of the telescoping member in a noninterfering relationship for maintaining the axial alignment of the handle and the telescoping member;

b. a detent mechanism carried by the telescoping member and adapted to project beyond the outer peripheral wall thereof, said detent mechanism movable between an extended, projecting position for selectively engaging said handle and locking the telescoping member relative thereto, in a retracted position for unlocking the telescoping member;

c. biasing means in communication with said detent means for normally urging the detent means into the extended position;

d. a first stop surface having a first tapered interperipheral wall portion intersecting the baton axis at a first acute angle and a second tapered interperipheral wall portion intersecting the baton axis at a second acute angle;

e. a complementary second stop surface on the outer peripheral wall of said telescoping member, said complementary stop surface including first and second tapered wall portions on said outer peripheral wall complementary with and intersecting the baton axis at the same angles as the first stop surface, whereby movement of the telescoping element from the retracted position to the extended position places the complementary first and second stop surfaces in positive, noninterfering engagement with one another; and f. an annular channel in said interperipheral wall of the handle for engaging the detent means when the telescoping element is in the retracted position for selectively locking the telescoping element in nested, retracted relationship with the handle.

13. The extendable baton of claim 12, wherein said handle further includes a generally cylindrical outer perimeter and wherein said detent means does not project beyond the handle perimeter when in the projecting position.

14. The extendable baton of claim 13, wherein said open end of the handle terminates in an abutment surface and wherein said detent means is in abutting engagement with said abutment surface when said telescoping member is in the extended position.

15. The extendable baton of claim 12, wherein said inner peripheral wall of the handle includes intent engaging means for engaging the detent means when the telescoping member is in the retracted position, for selectively locking the telescoping member in nested, retracted relationship with the handle.

16. The extendable baton of claim 12, wherein said detent means comprises an elongated, substantially cylindrical element having an outer, rounded tip, said outer, rounded tip being disposed in said annular channel when the telescoping member is in the nested, retracted position, whereby said rounded tip provides an inclined surface permitting retraction of the detent and extension of the telescoping member from the retracted position to the expanded position when a quick swinging action is applied to said handle

17. The extendable baton of claim 16, wherein said biasing means further comprises a compression spring disposed in said telescoping member and having a substantially flat, axially extending base for supporting the detent means, the base including opposite ends defining legs extending radially outward and intersecting the baton axis at an acute angle, said legs terminating in an outwardly tuned radius for preventing grabbing or gouging engagement of the spring with the telescoping member.

18. The extendable baton of claim 12, wherein said biasing means further comprises a compression spring disposed in said telescoping member and having a substantially flat, axially extending base for supporting the detent means, the base including opposite ends defining legs extending radially outward and intersecting the baton axis at an acute angle, said legs terminating in an outwardly tuned radius for preventing grabbing or gauging engagement of the spring with the telescoping member.

19. The extendable baton of claim 12, wherein said positive stop means further comprises:

a. a first stop surface having a first tapered inner peripheral wall portion intersecting the baton axis at a first acute angle and a second tapered inner peripheral wall portion intersecting the baton axis at a second acute angle; and b. and a complementary second stop surface on the outer peripheral wall of said telescoping member, said complementary stop surface including first and second tapered wall portions on said outer peripheral wall complementary with and intersecting the baton axis at the same angles as the first stop surface, whereby movement of the telescoping element from the retracted position to the extended position places the complementary first and second stop surface in positive, non-interfering engagement with one another.

* * * * *